US008351836B2

(12) United States Patent
Yonekawa

(10) Patent No.: US 8,351,836 B2
(45) Date of Patent: Jan. 8, 2013

(54) HEAT GENERATING ROLLER, FIXING DEVICE AND IMAGE FORMING APPARATUS

(75) Inventor: Noboru Yonekawa, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 224 days.

(21) Appl. No.: 12/862,408

(22) Filed: Aug. 24, 2010

(65) Prior Publication Data

US 2011/0052284 A1 Mar. 3, 2011

(30) Foreign Application Priority Data

Aug. 25, 2009 (JP) ..... 2009-194181

(51) Int. Cl.
*G03G 15/20* (2006.01)

(52) U.S. Cl. ..... 399/333; 219/216

(58) Field of Classification Search ..... 399/333, 399/330, 328; 219/216, 619
See application file for complete search history.

(56) References Cited

U.S. PATENT DOCUMENTS

2008/0145116 A1* 6/2008 Tamemasa et al. ..... 399/333 X
2008/0232873 A1 9/2008 Ueno et al.

FOREIGN PATENT DOCUMENTS

EP 1 377 127 1/2004
JP 2007-279672 A 10/2007
JP 2009-175200 A 8/2009
WO WO 2009-075114 A1 * 6/2009

OTHER PUBLICATIONS

European Search Report dated Jan. 14, 2011, issued in the corresponding European Patent Application No. 10173544.7-2209.

* cited by examiner

*Primary Examiner* — Sophia S Chen
(74) *Attorney, Agent, or Firm* — Buchanan Ingersoll & Rooney PC

(57) ABSTRACT

A heat generating roller which generates a heat when magnetic flux is applied from outside, which has high ability to control an amount of heat generation of itself and which has sufficient strength, including a main heating layer made of a material having a low electric resistivity, a heat controlling layer made of magnetic metal including at least nickel, a heat insulation layer having a low heat conductivity, and a stiff metal core, in order as above from outside, wherein the heat controlling layer is annealed, and the heat controlling layer and the heat insulation layer are bonded to each other.

18 Claims, 4 Drawing Sheets

HEAT GENERATING ROLLER, FIXING DEVICE AND IMAGE FORMING APPARATUS

This application is based on application No. 2009-194181 filed in Japan, the contents of which are hereby incorporated by reference.

FIELD OF THE INVENTION

The present invention relates to a heat generating roller, a fixing device and an image forming apparatus.

DESCRIPTION OF THE RELATED ART

It is publicly known that there is, for an image forming apparatus, a fixing device having a heat generating roller provided with a thin metal layer which generates a heat at vicinity of it surface by means of induction heating. Such a heat generating roller has a small heat capacity and generates large amount of heat, and therefore the heat generating roller can increase its temperature in a short time. Accordingly, such heat generating roller does not need to be pre-heated on standby, and makes a fixing device less consuming energy.

JP-2007-279672-A describes a heat generating sleeve (fixing belt) having a heat generating layer which consists of a main heating layer (inductively heat generating layer) made of copper and a heat controlling layer made of magnetic shunt alloy. In the heat generating sleeve, when the temperature of the magnetic shunt alloy is lower than the Currie temperature, the heat controlling layer of the magnetic shunt alloy as being ferromagnetic catches magnetic flux so as to bias the induced current (eddy current) in the main heating layer by skin effect so as to heat mostly the main heating layer. And, when the temperature of the magnetic shunt alloy is higher than the Currie temperature, the heat controlling layer consisting of the magnetic shunt alloy as being paramagnetic allows the magnetic flux to pass through so as to lead the magnetic flux to flux suppressing layer disposed inside of the heat generating sleeve, and thereby the amount of heat generation in the heat generating layer is reduced. As described above, in the heat generating sleeve configured to be capable of controlling an amount of heat generation of it self, the portion of the heat generating sleeve where is outside paper feeding area does not over heat, even if the paper feeding area is narrow.

Permalloy (Fe—Ni) is widely used as a magnetic shunt alloy which has a Currie temperature close to a fixing temperature in an image forming apparatus and which is variable widely in magnetic permeability. However, permalloy has a low strength. Therefore, if a heat generating sleeve is made of permalloy, the heat generating sleeve is problematically likely to break. Though permalloy should be annealed to obtain a preferable magnetic property, annealing of the heat generating sleeve causes not only that the strength of the permalloy is lowered but also that the strength of the copper forming the inductively heat generating layer is also lowered, consequently the heat generating sleeve can not obtain a required strength for a fixing device.

JP-2009-175200-A describes a fixing device provided with a fixing roller having a heat insulation layer with elasticity inside of a heat generating belt having a main heating layer made of nonmagnetic material and heat controlling layer made of magnetic material (permalloy) which has a Currie temperature same level as the fixing temperature, and with a pressurizing roller pressed to the fixing roller with interposition of the heat generating belt to form a nip. If this heat generating belt is annealed to improve the magnetic property of the permalloy, the heat generating belt will be insufficient in strength.

SUMMARY OF THE INVENTION

In view of the above problems, an object of the present invention is to provide a heat generating roller which has high ability to control an amount of heat generation of itself and which has sufficient strength, and a fixing device and an image forming apparatus which has a heat generating roller prevented from over heating partially.

In order to achieve the objects of the present invention, there is provided a heat generating roller which generates a heat when magnetic flux is applied from outside comprising a main heating layer made of a material having a low electric resistivity, a heat controlling layer made of magnetic metal consisting at least nickel, a heat insulation layer having a low heat conductivity, and a stiff metal core, in order as above from outside, wherein the heat controlling layer is annealed, and the heat controlling layer and the heat insulation layer are bonded to each other.

In the heat generating roller according to the present invention, the main heating layer may contain copper and/or may consist of unannealed plating material.

The metal core may be made of a nonmagnetic material having low electric resistivity. And the heat generating roller according to the present invention may have an oxidation resistant layer, an elastic layer and a releasing layer laminated on an outer surface of the main heating layer in order as above.

In accordance with the present invention, there is further provided a fixing device including a heat generating roller which generates a heat when magnetic flux is applied from outside comprising a main heating layer made of a material having a low electric resistivity, a heat controlling layer made of magnetic metal consisting at least nickel, a heat insulation layer having a low heat conductivity, and a stiff metal core, in order as above from outside, wherein the heat controlling layer is annealed, and the heat controlling layer and the heat insulation layer are bonded to each other, an exciting coil applying a magnetic flux to the heat generating roller, and a pressurizing roller pressed against the heat generating roller.

Further more, in order to achieve the another objects of the present invention, there is provided an image forming apparatus provided with a fixing device including a heat generating roller which generates a heat when magnetic flux is applied from outside comprising a main heating layer made of a material having a low electric resistivity, a heat controlling layer made of magnetic metal consisting at least nickel, a heat insulation layer having a low heat conductivity, and a stiff metal core, in order as above from outside, wherein the heat controlling layer is annealed, and the heat controlling layer and the heat insulation layer are bonded to each other, an exciting coil applying a magnetic flux to the heat generating roller, and a pressurizing roller pressed against the heat generating roller.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE PREFERRED EMBODIMENT

Figure 1:
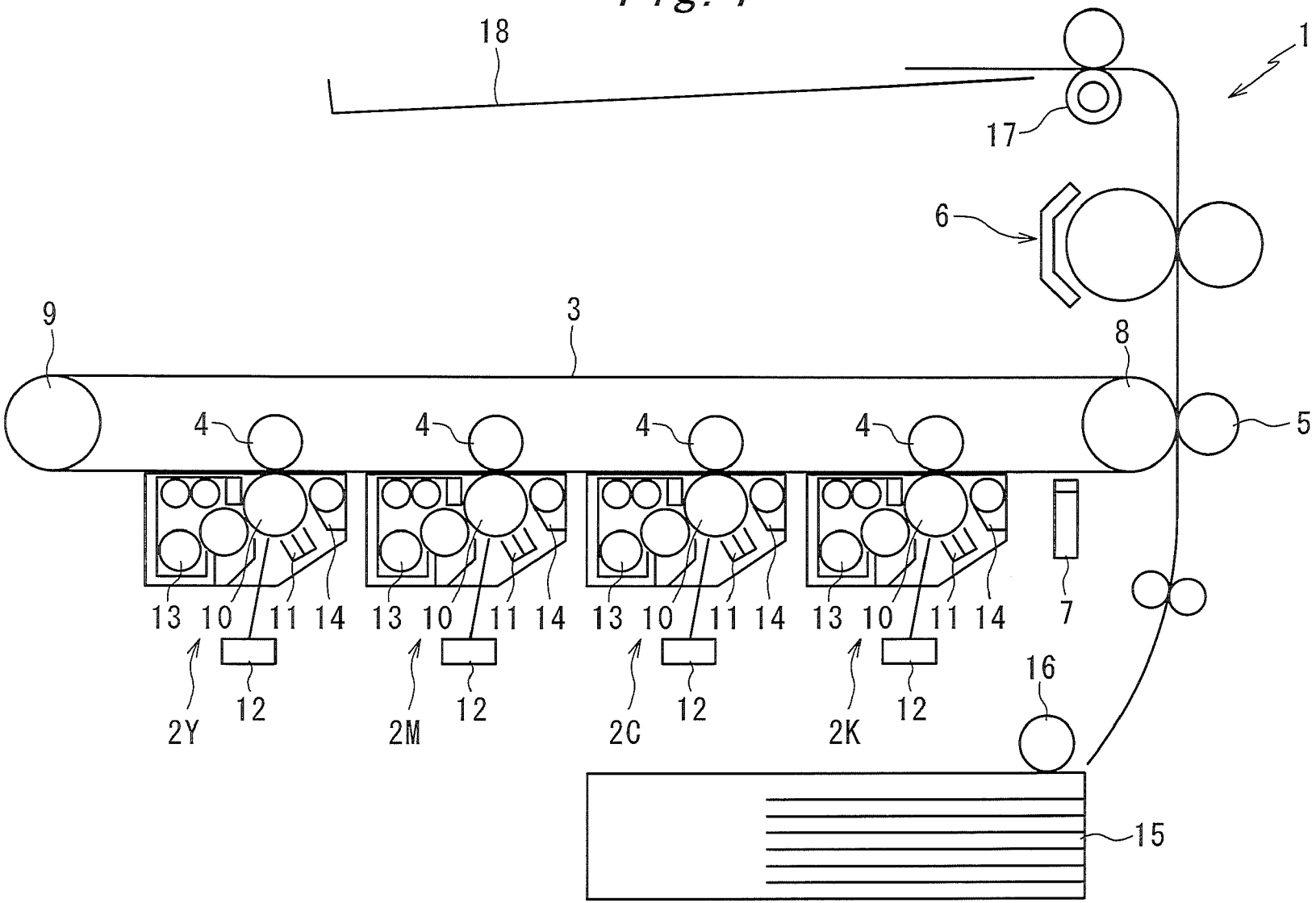
FIG. 1 is a configuration diagram of an image forming apparatus provided with a heat generating roller as first embodiment according to the present invention.

FIG. 1 shows an image forming apparatus 1 having a heat generating roller as first embodiment according to the present invention.

The image forming apparatus 1 as this embodiment is as a tandem type collar printer having four image forming portions 2Y, 2M, 2C, 2K, which form toner images with respective toner collared in yellow (Y), magenta (M), cyan (C) and black (B), a primary transfer roller 4 which primary transfers the toner images formed by the image forming portions 2Y, 2M, 2C, 2K onto an endless looped intermediate transfer belt 3 by an electrostatic force, secondary transfer roller 5 which in turn secondary transfer the toner image previously transferred to the transfer belt 3 onto a recording paper by an electrostatic force, and a fixing device 6 which fixes the toner image by heating and pressing the recording paper to melt the toner.

The image forming apparatus 1 has an image density sensor 7 which measures density of the toner image on the intermediate transfer belt 3. The image density sensor 7 also serves as a resister sensor. The intermediate transfer belt 3 is stretched over between a driving roller 8 and free roller 9.

Each of the collared image forming portions 2Y, 2M, 2C, 2K comprises a photoconductor 10, a charger 11 for charging the photoconductor 10, an exposure device 12 for selectively exposing the charged photoconductor 10 to form an electrostatic image, a developing device 13 for developing toner images by feeding toner to the electrostatic image, and a cleaner 14 for scraping off a toner which has failed to be transferred to the intermediate transfer belt 3 and is left on the photoconductor 10.

Further, the image forming apparatus 1 has sheet feeding tray 15 for feeding a recording paper. The recording paper is taken out from the sheet feeding tray 15 sheet by sheet, by a feeding roller 16, to be fed to a nip between the intermediate transfer belt 3 and the secondary transfer roller 5. The recording paper on which the toner image has been fixed by the fixing device 6 is discharged on the receiving tray 18 by a discharging roller 17.

Figure 2:
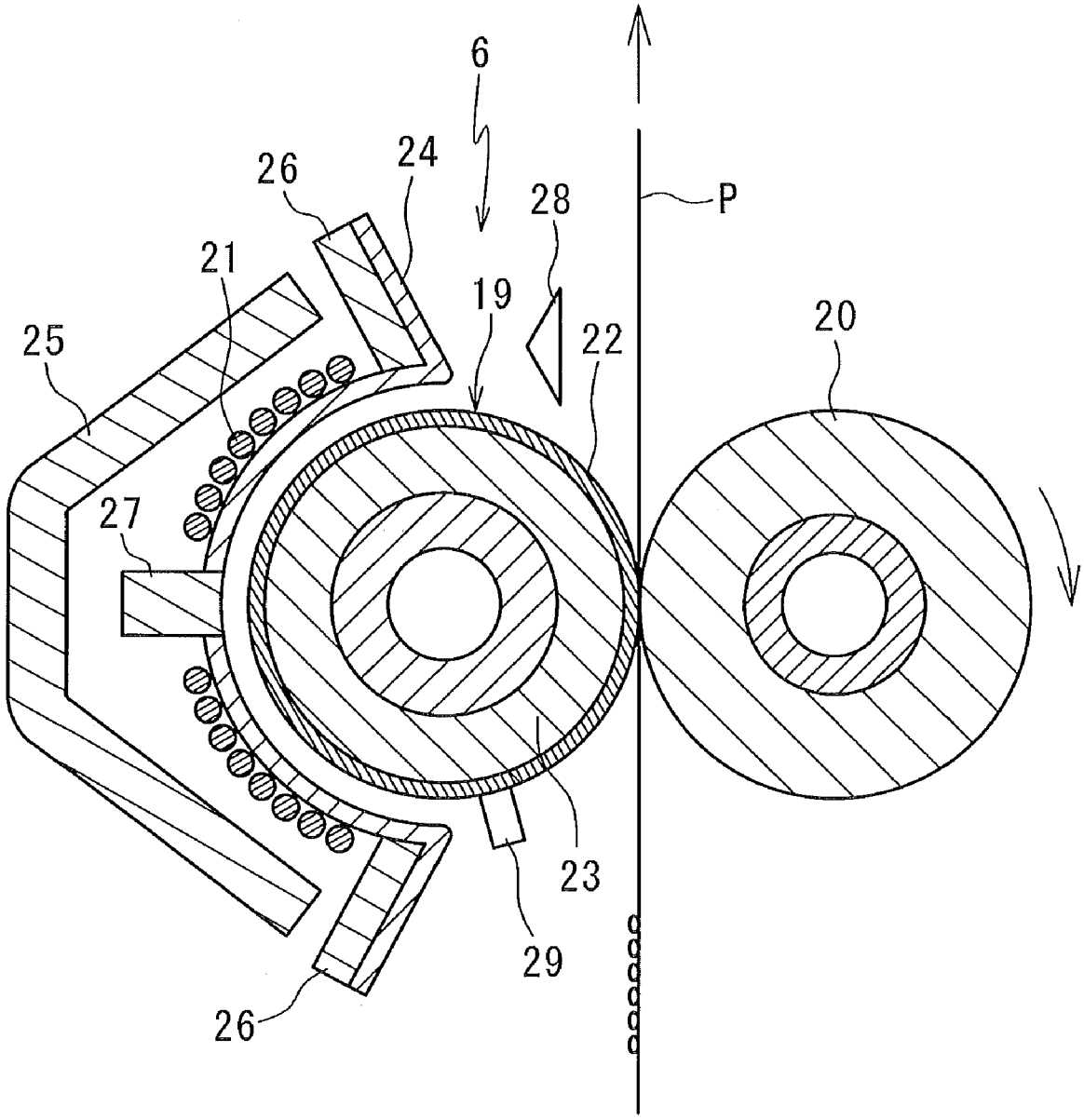
FIG. 2 is a sectional view of a fixing device in FIG. 1.

FIG. 2 shows the configuration of the fixing device 6 in detail. The fixing device 6 has a heat generating roller 19 according to the present invention, a pressurizing roller 20 pressed against the heat generating roller 19 so as to form a nip with a certain width for nipping the recording paper P, and an exciting coil 21 which is located on the side opposite to the pressurizing roller 20 so as to face to the heat generating roller 19 and which applies an alternating magnetic field to the heat generating roller 19.

The heat generating roller 19 consists of a sacrificial heat generating sleeve 22 and a fixing roller bonded to the inside of the heat generating sleeve 22 so as to rotate integrally with the heat generating sleeve 22.

The exciting coil 21 is formed of wire wound around a bobbin 24. In three directions in which the heat generating roller 19 is not residing around the exciting coil 21, cores 25, 26, 27 are arranged to guide the magnetic flux generated by the exciting coil 21. Further, the fixing device 6 has a separating claw 28 for separating the recording paper P from the heat generating roller 19 and a temperature sensor 29 detecting the temperature of the heat generating roller 19. The temperature sensor 29 is arranged so as to detect the temperature at a portion of the heat generating roller 19 where contacts to the recording paper P and is taken heat away regardless of size of the recording paper P.

The exciting coil 21 is applied from an unshown high-frequency inverter a high-frequency power at 20-40 kHz and at a power of 100-2000 W adjusted in response to the temperature detected by the temperature sensor 29. If the frequency of the high-frequency power is lower than 20 kHz, the efficiency of the heat generation gets down significantly. On the other hand, if the frequency is higher than 40 kHz, the power supply to the heat generating roller 19 is tight and so the temperature of the heat generating roller 19 can not increase sufficiently. Therefore, such condition is not preferable because it can cause a failure of fixing.

Figure 3:
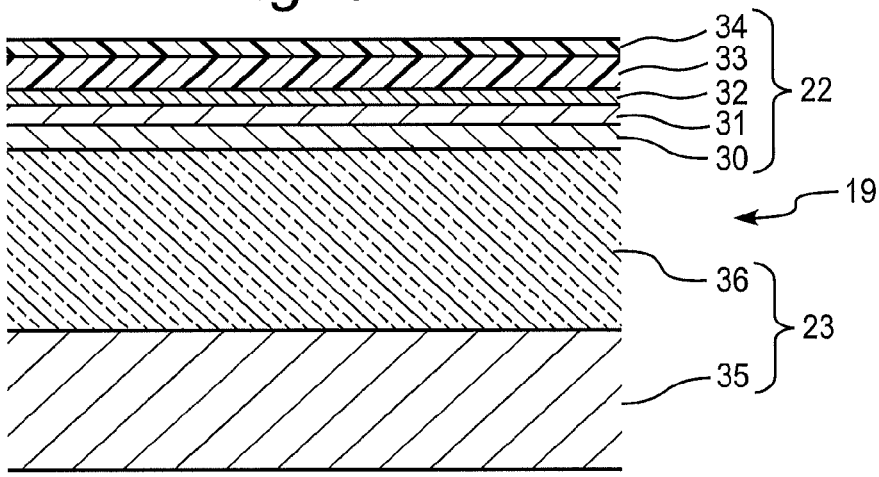
FIG. 3 is enlarged partial sectional view of the fixing device in FIG. 2.

FIG. 3 shows a detailed construction of the heat generating roller 19. The heat generating sleeve 22 of the heat generating roller 19 consists of a heat controlling layer 30, a main heating layer 31, an oxidation resistant layer 32, an elastic layer 33 and a releasing layer 34, laminated in this order from inside. The fixing roller 23 has a metal core 35 and a heat insulation layer 36 on a circumference of the metal core 35.

The heat generating sleeve 22 is made by forming the heat controlling layer 30, forming the main heating layer 31 on the heat controlling layer 30, forming the oxidation resistant layer 32 on the main heating layer 31, further superimposing the elastic layer 33 on the oxidation resistant layer 32, and finally forming the releasing layer 34 on the elastic layer 33.

The heat controlling layer 30 is maid by drawing of a sheet of permalloy in a bottomed tubular shape with a side wall having a thickness of 20-200 μm, preferably 30-70 μm, first, and then by cutting off the bottom to form an endless roller. Alternatively, the heat controlling layer 30 may be maid by plastic forming such as deep drawing and spinning. Also, the heat controlling layer 30 may be formed in a shape of endless roller by electrolytic plating to forming layer of permalloy.

The composition of the permalloy is chosen so that the Currie temperature is 150-220° C., preferably, 180-200° C. when a fixing temperature is 170-190° C. and that the volume resistivity at a low temperature lower than the Currie temperature is $2\times10^{-8}$–$200\times10^{-8}\Omega$, preferably, $5\times10^{-8}$–$100\times10^{-8}\Omega$. The permalloy formed in a roller shape in turn is annealed to get a relative magnetic permeability of 50-2,000, preferably, 100-1,000 at normal temperature (lower than the Currie temperature).

Figure 4:
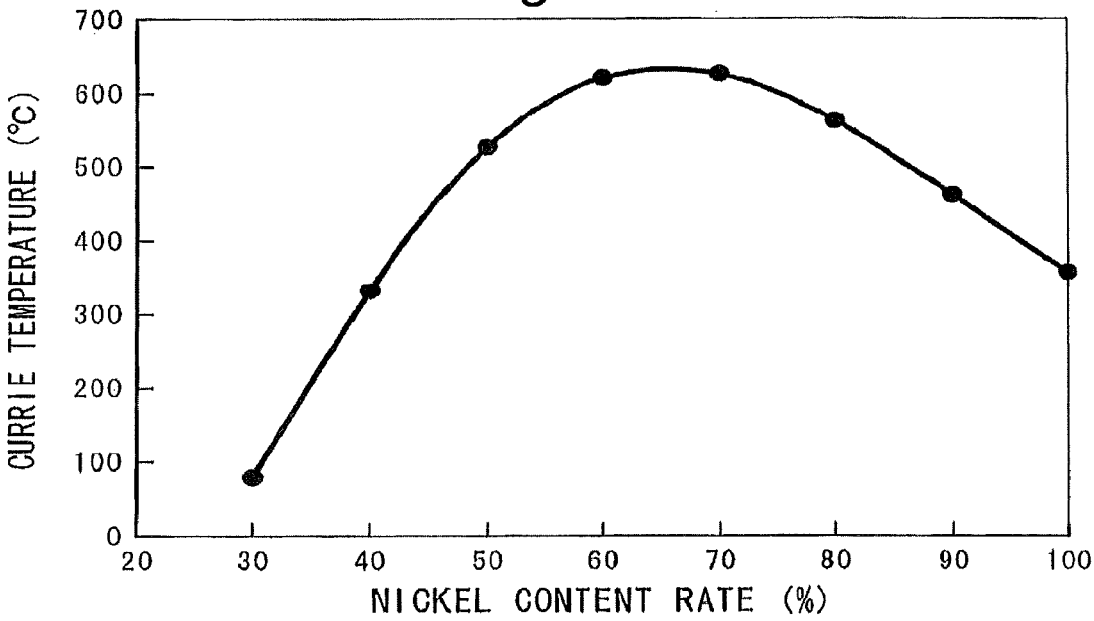
FIG. 4 is a chart representing a relation between content rate of nickel in permalloy and Currie temperature.

If iron contains nickel, as shown in FIG. 4, Currie temperature varies depending on the content rate of nickel. Therefore, a Currie temperature of permalloy can be adjusted by the content rate of nickel. Further, a Currie temperature can be also adjusted by containing of chrome cobalt, molybdenum and the like. Notably, FIG. 4 shows data of Currie temperatures (Tc) of test materials which are formed in a sheet-like shapes from permalloy by electrolytic plating and annealed one hour at 800° C., measured by B-H analyzer maid by IWATSU TEST INSTRUMENTS.

It is desirable that the annealing process is conducted in a vacuum or under a helium gas atmosphere so as to keep the temperature at 600-1200° C., preferably in range of 800-1000° C., for 0.2-4 hours, preferably for 0.5-2 hours.

Though it is preferable that the heat controlling layer 30 has a Currie temperature close to the fixing temperature, the heat controlling layer 30 having a Currie temperature higher than the fixing temperature also can provide a temperature controlling effect. Therefore, not only permalloy, but also a magnetic metal such as a nickel alloy and a stainless steel may be used for the heat controlling layer 30.

Around a circumference of a heat controlling layer 30 maid from permalloy by forming in a roller shape and annealing, a main heating layer 31 is formed by metal plating. The main heating layer 31 is formed of a much conductive magnetic metal material, preferably from copper of copper alloy, specifically having a volume resistivity of $0.5\times10^{-8}$–$20\times10^{-8}$ Ωm, preferably of $0.5\times10^{-8}$–$10\times10^{-8}$ Ωm when the temperature of the heat controlling layer 30 is lower than the Currie temperature and a relative magnetic permeability of 0.99-20. The main heating layer 31 made from the above mentioned material is preferably formed in a thickness of 5-20 μm. In this embodiment, the main heating layer 31 is formed by plating of copper in a thickness of 10 μm.

Also, the main heating layer 30 can be formed from a magnetic material like nickel. Alternatively, the main heating layer 30 may be formed from a resin with dispersed copper, argentine or the like. An application of resin material contributes to enhancing the flexibility of the heat generating sleeve 22, and to improve separation of the recording paper P from the heat generating sleeve 22 accordingly.

When the temperature of the heat controlling layer 30 is lower than the Currie temperature, the magnetic flux generated by the exciting coil 21 is caught by the heat controlling layer 30 and main heating layer 31 with a high magnetic permeability to cause a eddy current inside of the heat controlling layer 30 and main heating layer 31. The eddy current flows in concentrated in the main heating layer 31 with a low resistance so as to generate Joule heat mostly in the main heating layer 31.

If the main heating layer 31 is maid of a magnetic material, a skin effect is strong to flow the eddy current in a restricted range regardless the thickness of the main heating layer 31, therefore the current density is high and the amount of heat generation is large. But, if the main heating layer 31 is formed of magnetic material, a skin effect is weak to flow the eddy current in whole of the main heating layer 31 so that the amount of heat generation tend to be lower. Therefore, in the case where a nonmagnetic material is used to form the main heating layer 31 as in this embodiment, it is appropriate to form the main heating layer 31 thinner in a thickness around 5-20 μm as described above, so as to make a resulted current density high to ensure a sufficient amount of heat generation, even if the eddy current flows spreading throughout the entire main heating layer 31.

In contrast, when the temperature of the heat controlling layer 30 is higher than the Currie temperature, the heat controlling layer 30 with a lowered magnetic permeability can not catch the magnetic flux generated by the exciting coil 21 sufficiently, and therefore allows the magnetic flux to pass through to inside. Thereby, the eddy current flowing in the main heating layer 31 are reduced so that the amount of heat generation in the main heating layer 31 gets lower than that when the temperature of the heat controlling layer 31 is lower than the Currie temperature.

As described above, the heat generating roller 19 suppresses an amount of heat generation by itself at the portion where the temperature of the heat controlling layer 30 has reached to the Currie temperature. Therefore, even if the power inputted to the exciting coil 21 is controlled so as to keep the temperature at the portion where is removed heat from by a recording paper P passed through at a predetermined fixing temperature, the portion where is not removed heat from by a recording paper P is never heated excessively to a temperature causing a problem in the fixing of image.

And, if the main heating layer 31 is formed of easily oxidizable copper and the like as in this embodiment, an oxidation protection layer 32 is preferably provided between the main heating layer 31 and the elastic layer 33 to prevent the main heating layer 31 from oxidizing. In the case where the main heating layer 31 is formed of copper, an oxidized film grows rapidly and the strength of the oxidized film is very weak, therefore the oxidized film is highly possible to delaminate causing a detachment of the elastic layer 33. Hence, it is required to prevent outer air from contacting to the main heating layer 31 by an oxidation protection layer, so as to allow the adhesion between the main heating layer 31 and the elastic layer 33 described below in detail to be maintained over a long duration.

As a material of the oxidation protection layer, metallic materials completely without air permeability are preferred, and nonmagnetic low resistive material is more preferable to form thinly the oxidation protection layer. Particularly, nickel, chrome and argentine is suitable for the oxidation protection layer, because these can be formed in a thin-wall, and have less influence to a heat generation property and a good adhesiveness to the elastic layer. The oxidation protection layer has a thickness preferably in a range of 0.5-40 μm. Because a thickness less than 0.5 μm can degrade the sealing property with a pinhole, and a thickness more than 40 μm can influence to the heat generating property, particularly to the overheating prevention effect.

Alternatively, polyimide resin and the like can be used as a material of the oxidation protection layer. Polyimide resin is electric insulating material, and therefore never influences to the heat generation property. However, polyimide resin has a slight air permeability in comparison to metallic material, hence the oxidation protection layer has a thickness preferably of 3-70 μm. Because a thickness less than 3 μm with lack of sealing property can allow the oxidized film to grow, and a thickness more than 70 μm is hard to transmit a heat generated in the main heating layer 31 to the outer surface of the pressurizing roller 20 so that heat efficiency is reduced.

Further, the heat generating roller 19 is composed by forming the main heating layer 31 by metal plating on the heat controlling layer 30 and forming the oxidation protection layer as necessary, after that, by forming a elastic layer 33 so as to cover the main heating layer 31. The elastic layer 33 is to transmit a heat uniformly and flexibly to a toner image. Since the elastic layer 33 has an appropriate elasticity, an image noise due to crushing and/or unequal melting of a toner image is prevented.

Therefore, the elastic layer 33 is formed of rubber material or resin material having heat resistance and elasticity, for example, heat resistant elastomer usable at the fixing temperature such as silicone rubber or fluorine rubber. Further, into these materials, various additive agents may be filled for the purpose of adding heat conductivity, reinforcement and so on. As examples of particles added for enhancing heat conductivity, diamond, argentine, copper, aluminum, marble stone and glass, and more practically, silica, alumina, magnesium oxide, borate nitride and beryllium oxide are recited.

The elastic layer 33 has a thickness of 10-800 μm preferably of 100-300 μm. Because, the elastic layer 33 is difficult with a thickness less than 10 μm to obtain a sufficient elasticity in direction of the thickness, and the elastic layer 33 is difficult with a thickness more than 800 μm to transmit a heat generated in the main heating layer 31 to the outer surface of the pressurizing roller 20.

The elastic layer 33 has a hardness of 1-80, preferably of 5-30 in JIS hardness. Because, with a hardness in this range, the elastic layer 33 is prevented from degrading in the strength and/or in the adhesiveness and ensures a stable fixing ability. As resins meeting this requirement, silicone rubber of one component, two components or more than two components type, LTV (Low Temperature Vulcanizable) type, RTP (Room Temperature Vulcanizable) type or HTP (High Temperature Vulcanizable) type of silicone rubber, and condensed type or added type of silicone rubber can be used.

Further, the heat generating roller 19 is provided with the releasing layer 34 formed on the elastic layer 33. The releasing layer 34 composes the outermost layer of the heat generating roller 19 to enhance detachability of the recording paper P from the heat generating roller 19. For this releasing layer 34, a material which wears in use at the fixing temperature and which has good detachability for toner is used. For instance, preferred are silicone rubber and fluorine rubber, or fluorine resin such as PFA (tetrafluoroethylene-perfluoroalkoxyethylene copolymer), PTFE (polytetrafluoroethylene), FEP (polytetrafluoroethylene-hexafluoroethylene copolymer) and PFEP (polytetrafluoroethylene-hexafluoropropylene copolymer) and mixture thereof.

The releasing layer 34 has a thickness of 5-100 μm, preferably in a range of 10-50 μm. Further, an adhesion process such as application of primer may be conducted to improve a adhering force between the releasing layer 34 and the elastic layer 33. And, electric conductive agent, abrasion-resistant agent, heat conductive agent and the like may be filled as filler into the releasing layer 34 as necessary.

To produce the heat generating roller 19, the internal fixing roller 23 is prepared separately from the heat generating sleeve 22. The metal core 35 is made of a nonmagnetic law-resistance metal with sufficient thickness, for instance an aluminum material with a thickness of 3 mm.

When the temperature of the heat controlling layer 30 has reached to the Currie temperature, the main heating layer 31 and the heat controlling layer 30 can not catch all of the magnetic flux generated by the exciting coil 21, and a part of the magnetic flux passes thorough the heat controlling layer 30 and then thorough the metal core 35 of the fixing roller 23. Since the metal core has a low resistivity, a big eddy current flows. This eddy current forms a magnetic field canceling the magnetic flux generated by the exciting coil 21 so as to reduce the magnetic flux density applied to the main heating layer 30 to reduce the amount of heat generation in the main heating layer 30 consequently.

Since the material of the metal core 35 is nonmagnetic, a skin effect off the metal'core 35 is small. Further, the metal core 35 has a sufficient thickness, and therefore an eddy current spreadingly flows through the metal core 35. Accordingly, the current density of the eddy current flowing through the metal core 35 is held down, and any substantial Joule heat is not generated in the low resistant metal core 35.

Further, the fixing roller 23 of the heat generating roller 19 is provided with the insulating layer around the metal core 35 so that the heat dose not transfer from the heat generating sleeve 22 to the metal core 35.

Accordingly, the insulating layer 36 is formed preferably of a foam of rubber material or resin material having low heat conductivity and heat resistance. Further, if the insulating layer 36 is made from a material having elasticity, a deflection of the heat generating roller 19 is allowed and a large width of nip can be maintained. And a double layered structure consisting of a solid body and a foamed body may be employed as the insulating layer 36.

For instance, in the case of using a foamed silicone material as the insulating layer 36, the insulating layer 36 is to be formed in a thickness of 1-10 mm, preferably of 2-7 mm. The hardness of the insulating layer 36 is 20-60 degree, preferably of 30-50 degree in Asker C hardness.

The heat generating sleeve 22 and the fixing roller 23 formed independently as described above finally are bonded to each other with an adhesive. Therefore, the inner diameter of the heat generating sleeve (the heat controlling layer 30) is formed larger than the outer diameter of the fixing roller 23 (heat insulation layer 36) by about 0.2-1.0 mm. An adhesive is applied on the inner surface of the heat generating sleeve 22 or the outer surface of the fixing roller 23, and then the fixing roller 23 is inserted into the heat generating sleeve 22 to bond them.

As the adhesive, silicon type bond to be heated for hardening may be used. Further, the inner surface of the heat generating sleeve 22 or the outer surface of the fixing roller 23 may be subjected to a primer treatment as necessary.

By bonding the heat generating sleeve 22 and the fixing roller 23, the heat generating sleeve 22 is prevented from skewing. Thereby, any stress due to a skewing is not applied to the heat generating layer 30 of which strength is decreased through an annealing treatment, and therefore a damage of the heat generating layer 30 is avoided, hence the heat generating roller 19 is les damaged. Consequently, downtime of the image forming apparatus 1 for replacing the heat generating roller 19 can be reduced.

Figure 5:
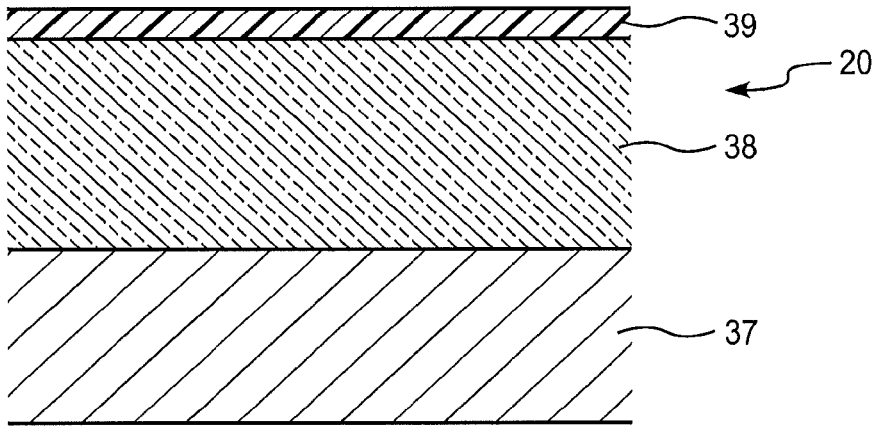
FIG. 5 is a enlarged partial sectional view of a pressurizing roller in the FIG. 2.

FIG. 5 shows the configuration of the pressurizing roller 20. The pressurizing roller 20 is provided with an insulating layer 38 formed on a metal core and with a releasing layer 39 further formed on the insulating layer 38. The metal core 37 is composed of a pipe of aluminum having a wall thickness of 3 mm for example, and if sufficient strength can be ensured, a molded pipe of heat resistive material such as PPS may be used alternatively. It is not impossible to use an iron pipe as the metal core 37, but nonmagnetic one which is insusceptible to electromagnetic induction is more preferable.

The insulating layer 38 of the pressurizing roller 20 is composed of a layer, for instance, of silicone rubber foam with a thickness of 3-10 mm, also may be formed in a configuration double layered consisting of a silicone rubber solid and a silicone rubber foam.

The releasing layer 39 as the outermost layer of the pressurizing roller 20 is to enhance detachability of the pressurizing roller 20 with respect to the recording paper P, similarly to the releasing layer 34 of the pressurizing roller 20. This releasing layer 39 is preferably formed of fluorinated resin such as PTFE or PFA with a thickness of 10-50 μm.

Notably, in this embodiment, the pressurizing roller 20 is pressed against the pressurizing roller 20 at a load of 300-500N to form a nip where the heat generating roller 19 and the pressurizing roller 20 are pressed to each other with a width of 5-15 mm. If the fixing device 6 is wanted to be used with a different nip width from the present embodiment, pressing load of the pressurizing roller 20 may be adjusted.

In a fixing process, the pressurizing roller 20 is driven in a clockwise direction in the FIG. 2. Thereby, the heat generating roller 19 and pressurizing roller 20 is rotationally driven in a counterclockwise direction in the Figure by the frictional force with the pressurizing roller 20. It is noted that the pressurizing roller 20 may be driven to rotate indirectly the heat generating roller 19 and the pressurizing roller 20.

The exciting coil 21 is a coil wound along a longitudinal direction of the heat generating roller 19. A cross-section of the exciting coil 21 is, as sown in FIG. 2, formed in a shape curved along the circumference of the heat generating roller 19.

In this embodiment, as a winding wire, a litz wire consisting of corded tens to hundreds of fine wire is used. As this exciting coil 21 itself generates a heat due to the resistance of the winding wire when a current is applied, a wire coated with a heat resistive resin is used as the winding wire to maintain its insulation property when the exciting coil 21 heats up. Further, it is preferred to air-cool the exciting coil 21, for instance, with a fan and the like. It is noted that the exciting coil 21 in this embodiment is unbroken in the longitudinal direction.

The cores 25, 26, 27 are arranged to enhance the efficiency of the magnetic circuit and to prevent the magnetic flux from leaking outside. Therefore, the cores 25, 26, 27 are made of a material having high magnetic permeability and a low eddy current loss. Further, it is better to use for the cores 25, 26, 27 a material having a Currie temperature of 140-220° C., preferably of 160-200° C.

If the cores 25, 26, 27 are formed of an alloy having high magnetic permeability such as permalloy, the eddy current loss is likely to increase. Therefore, in the case of using this kind of material, it is preferred that the cores have configurations in which thin sheets are layered. Also, a material with magnetic powder dispersed in a resin can be used for the cores 25, 26, 27. Such material has lower magnetic permeability, but it also has an advantage that any shape can be chosen for the cores. If a magnetic shielding of the magnetic circuit of the exciting coil 21 from outside can be achieved, the fixing device 6 may be configured without core (with air core) with omitting the cores 25, 26, 27.

The core 25 has a cross section, as shown in FIG. 2, formed in an arched shape. In this embodiment, the core 25 consists of 13 core pieces having a length of about 10 mm and aligned in the axial direction of the pressurizing roller 20. The core 26 consists of core pieces having a rectangular formed cross section and a length of 5-10 mm, and arranged on both side of the heat generating roller 19. And the core 27 consists of core pieces having a rectangular formed cross section and arranged in a row in an area inside the exciting coil 21 and corresponding to the longitudinal dimension of the heat generating roller 19. Moreover, if the cores 25, 26, 27 are integrally formed generally in an shape in its cross section, the efficiency of heat generation is further increased.

Figure 6:
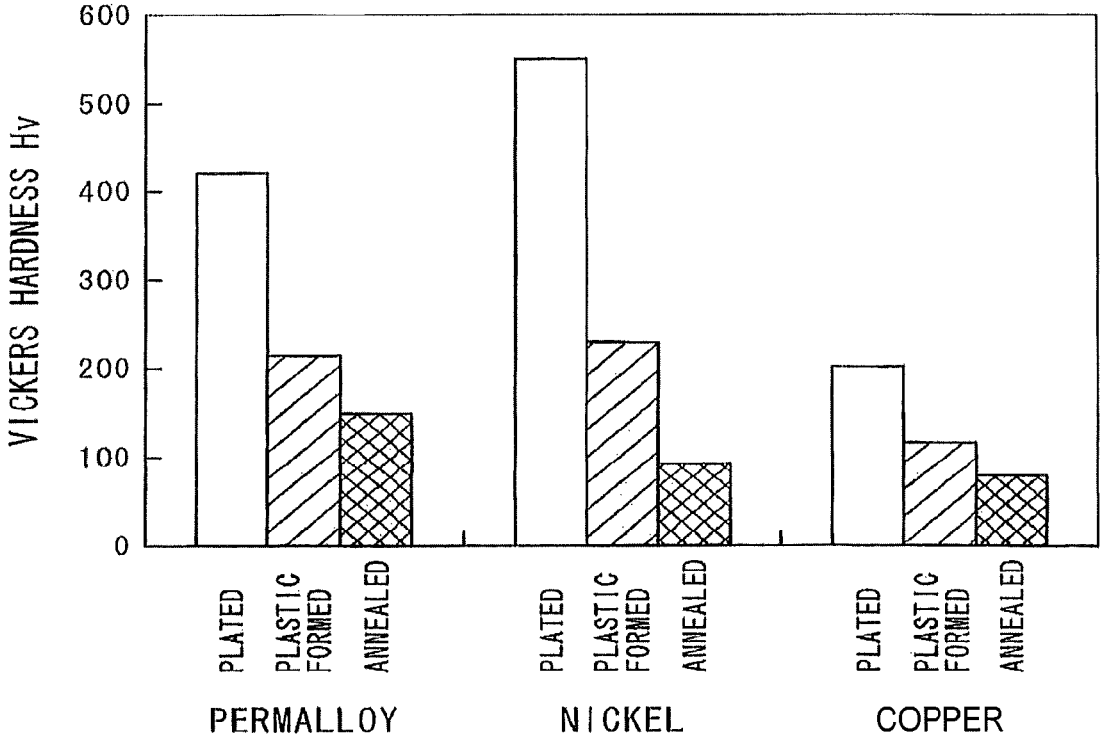
FIG. 6 is a chart representing variance in hardness depending on material and forming method.

FIG. 6 shows a variation of strength of permalloy (with nickel content rate of 34%), pure nickel and copper in response to processing methods. It is noted that with respect to each materials, three test pieces in a same shape are made as an unannealed plated piece which is formed in a predetermined shape by electrolytic plating, an unannealed plastic formed piece which is formed in the predetermined shape by plastic forming and an annealed piece which is subjected to an annealed process for one hour at 800° C., and Vickers hardness (Hv) of each test pieces is measured with a Vickers microhardness tester.

Any material shows the highest strength as in the plated piece and the lowest strength as in the annealed piece. In accordance with the present invention, the heat controlling layer 30 is formed of permalloy and provided a preferable magnetic property. After the annealing process, the main heating layer 31 is formed by metal plating, and therefore the strength of the main heating layer 31 is not decreased by an annealing process. Accordingly, the main heating layer 31 compensates for the decreased strength of the heat controlling layer 30 through the annealing process.

Consequently, although the heat generating roller 19 performs a high degree of self controlling of the amount of heat generation with the heat controlling layer 30, the heat generating roller 19 has a sufficient strength not to break easily even if a deformation is caused to form the nip.

Furthermore, because the heat generating sleeve 22 is prevented from skewing in the heat generating roller 19 by bonding the heat generating sleeve 22 and the fixing roller 23, the heat generating roller 19 is not applied any excessive stress and so less damaged.

As described above, according to the present invention, a heat generating roller which generates a heat when magnetic flux is applied from outside comprises a main heating layer made of a material having a low electric resistivity, a heat controlling layer made of magnetic metal consisting at least nickel, a heat insulation layer having a low heat conductivity, and a stiff metal core, in order as above from outside, wherein the heat controlling layer is annealed, and the heat controlling layer and the heat insulation layer are bonded to each other.

In accordance with this configuration, the heat controlling layer is made of unannealed magnetic metal to obtain the optimum magnetic property. And the heat controlling layer is bonded to the heat insulation layer to prevent from skewing so as to prevent the heat generating roller from damage.

In the heat generating roller according to the present invention, the main heating layer contains copper which has a low resistance, to cause a high power factor so as to achieve high power supply efficiency and high heat generation efficiency.

In the heat generating roller according to the present invention, the main heating layer is made of a plating material and is not annealed to obtain sufficient strength.

In the heat generating roller according to the present invention, the metal core is made of a nonmagnetic material having low electric resistivity. Thereby, magnetic flux passed through the heat controlling layer when the heat controlling layer has reached further penetrate the metal core to cause eddy current in the metal core. The eddy current caused in the metal core cancels the magnetic flux so as to reduce the number of the magnetic flux passing thorough the main heating layer to reduce furthermore the amount of heat generation.

In the heat generating roller according to the present invention, an oxidation resistant layer, an elastic layer and a releasing layer are laminated on an outer surface of the main heating layer in order as above. The oxidation resistant layer prevent the main heating layer from corrosion to ensure the bonding between the main heating layer and the elastic layer for long periods.

A fixing device according to the present invention includes the heat generating roller as describe above, an exciting coil applying a magnetic flux to the heat generating roller, and a pressurizing roller pressed against the heat generating roller. I accordance with this configuration, the heat generating roller can control an amount of heat generation to prevent partial overheat by itself and has sufficient strength to withstand a deformation to form a nip. And because the heat controlling layer is bonded to the heat insulation layer, the heat controlling layer is not applied any successive stress due to skewing. Consequently, the fixing device has a high fixing performance and is less trouble.

An image forming apparatus according to the present invention is provided with the fixing device described above. According to this configuration, fixing of the image is stable thanks to the function of self-controlling of an amount of heat generation the heat generating roller. And since the heat generating roller is less damaged, downtime of image forming apparatus is reduced.

Consequently, in accordance with the present invention, a heat controlling layer of a heat generating roller can be provided a preferable magnetic property by forming the heat controlling layer from a magnetic shunt alloy, and can be prevented from damage by bonding to a heat insulation layer to prevent skewing.

Although the present invention has been fully described in connection with the preferred embodiment thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A heat generating roller which generates a heat when magnetic flux is applied from outside comprising:

a main heating layer made of a material having a low electric resistivity, a heat controlling layer made of magnetic metal including at least nickel, a heat insulation layer having a low heat conductivity, and a stiff metal core, in order as above from outside, wherein the heat controlling layer is annealed, and the heat controlling layer and the heat insulation layer are bonded to each other.

2. The heat generating roller according to the claim 1, wherein the main heating layer contains copper.

3. The heat generating roller according to the claim 1, wherein the main heating layer is made of a plating material and is not annealed.

4. The heat generating roller according to the claim 1, wherein the metal core is made of a nonmagnetic material having low electric resistivity.

5. The heat generating roller according to the claim 1, wherein an oxidation resistant layer, an elastic layer and a releasing layer are laminated on an outer surface of the main heating layer in order as above.

6. The heat generating roller according to the claim 1, wherein the heat controlling layer possesses opposing faces, one of the opposing faces contacting the main heating layer, and an other of the opposing faces contacting the heat insulation layer; and wherein the heat controlling layer is configured to permit the magnetic flux to pass through the heat controlling layer when a temperature of the heat controlling layer exceeds a certain temperature.

7. A fixing device comprising:

a heat generating roller which generates a heat when magnetic flux is applied from outside comprising a main heating layer made of a material having a low electric resistivity, a heat controlling layer made of magnetic metal including at least nickel, a heat insulation layer having a low heat conductivity, and a stiff metal core, in order as above from outside, wherein the heat controlling layer is annealed, and the heat controlling layer and the heat insulation layer are bonded to each other, an exciting coil applying a magnetic flux to the heat generating roller, and a pressurizing roller pressed against the heat generating roller.

8. The fixing device according to the claim 7, wherein the main heating layer contains copper.

9. The fixing device according to the claim 7, wherein the main heating layer is made of a plating material and is not annealed.

10. The fixing device according to the claim 7, wherein the metal core is made of a nonmagnetic material having low electric resistivity.

11. The fixing device according to the claim 7, wherein an oxidation resistant layer, an elastic layer and a releasing layer are laminated on an outer surface of the main heating layer in order as above.

12. The fixing device according to the claim 7, wherein the heat controlling layer possesses opposing faces, one of the opposing faces contacting the main heating layer, and an other of the opposing faces contacting the heat insulation layer; and wherein the heat controlling layer is configured to permit the magnetic flux to pass through the heat controlling layer when a temperature of the heat controlling layer exceeds a certain temperature.

13. An image forming apparatus provided with a fixing device comprising:

a heat generating roller which generates a heat when magnetic flux is applied from outside comprising a main heating layer made of a material having a low electric resistivity, a heat controlling layer made of magnetic metal including at least nickel, a heat insulation layer having a low heat conductivity, and a stiff metal core, in order as above from outside, wherein the heat controlling layer is annealed, and the heat controlling layer and the heat insulation layer are bonded to each other, an exciting coil applying a magnetic flux to the heat generating roller, and a pressurizing roller pressed against the heat generating roller.

14. The image forming apparatus according to the claim 13, wherein the main heating layer contains copper.

15. The image forming apparatus according to the claim 13, wherein the main heating layer is made of a plating material and is not annealed.

16. The image forming apparatus according to the claim 13, wherein the metal core is made of a nonmagnetic material having low electric resistivity.

17. The image forming apparatus according to the claim 13, wherein an oxidation resistant layer, an elastic layer and a releasing layer are laminated on an outer surface of the main heating layer in order as above.

18. The image forming apparatus according to the claim 13, wherein the heat controlling layer possesses opposing faces, one of the opposing faces contacting the main heating layer, and an other of the opposing faces contacting the heat insulation layer; and wherein the heat controlling layer is configured to permit the magnetic flux to pass through the heat controlling layer when a temperature of the heat controlling layer exceeds a certain temperature.

* * * * *